US006883556B2

(12) United States Patent
Fahrer et al.

(10) Patent No.: US 6,883,556 B2
(45) Date of Patent: Apr. 26, 2005

(54) DOUBLE CROSS PARALLEL BINDER FABRIC

(75) Inventors: Ernest Fahrer, Kintzheim (FR); Monique Fagon, Erstein (FR)

(73) Assignee: Albany International Corp., Albany, NY (US)

( * ) Notice: Subject to any disclaimer, the term of this patent is extended or adjusted under 35 U.S.C. 154(b) by 125 days.

(21) Appl. No.: 10/334,166

(22) Filed: Dec. 30, 2002

(65) Prior Publication Data

US 2004/0173273 A1 Sep. 9, 2004

(51) Int. Cl.[7] ..... D03D 13/00

(52) U.S. Cl. ..... 139/383 A; 442/203; 442/205; 162/900; 162/902; 162/903

(58) Field of Search ..... 139/383 R, 383 A; 442/203, 205; 162/900, 902, 903

(56) References Cited

U.S. PATENT DOCUMENTS

| | | | | | |
|---|---|---|---|---|---|
| 4,314,589 | A | | 2/1982 | Buchanan et al. | |
| 4,501,303 | A | | 2/1985 | Osterberg | |
| 5,013,330 | A | * | 5/1991 | Durkin et al. | 51/297 |
| 5,151,316 | A | * | 9/1992 | Durkin et al. | 428/213 |
| 5,152,326 | A | | 10/1992 | Vohringer | |
| 5,507,915 | A | * | 4/1996 | Durkin et al. | 162/117 |
| 5,709,205 | A | | 1/1998 | Bukta | |
| 5,826,627 | A | | 10/1998 | Seabrook et al. | |
| 5,881,704 | A | | 3/1999 | Andrews | |
| 5,917,185 | A | | 6/1999 | Yeung et al. | |
| 5,937,914 | A | | 8/1999 | Wilson | |
| 5,944,062 | A | | 8/1999 | Gampe | |
| 5,967,195 | A | | 10/1999 | Ward | |
| 6,145,550 | A | | 11/2000 | Ward | |
| 6,202,705 | B1 | * | 3/2001 | Johnson et al. | 139/383 A |
| 6,207,598 | B1 | | 3/2001 | Lee et al. | |
| 6,240,973 | B1 | | 6/2001 | Stone et al. | |
| 6,276,402 | B1 | | 8/2001 | Herring | |
| 6,581,645 | B1 | * | 6/2003 | Johnson et al. | 139/383 A |
| 2003/0010393 | A1 | | 1/2003 | Kuji | |

FOREIGN PATENT DOCUMENTS

| | | | |
|---|---|---|---|
| CA | 2352898 | A | 10/2001 |

* cited by examiner

*Primary Examiner*—John J. Calvert
*Assistant Examiner*—Robert H. Muromoto, Jr.
(74) *Attorney, Agent, or Firm*—Frommer Lawrence & Haug LLP; Ronald R. Santucci

(57) ABSTRACT

A multi-layer fabric which may be utilized in a papermaking process. Such fabric has a first layer having machine direction (MD) yarns and cross-direction (CD) yarns interwoven therewith and a second layer having machine direction (MD) yarns and cross-direction (CD) yarns interwoven therewith. In such fabric, a plurality of pairs of first type of binders each having a first binder and a second binder are interwoven with the first and second layers. The first and second binders of at least one pair are interwoven with the first and second layers so as to pass over at least one same yarn on an outer surface of the first layer.

32 Claims, 10 Drawing Sheets

| | | | | | | | | | | | | | | | | | | | | |
|---|---|---|---|---|---|---|---|---|---|---|---|---|---|---|---|---|---|---|---|---|
| 1 | | 2 | 3 | 4 | 5 | 6 | | 8 | | 10 | | | | 14 | | | | | | |
| 2 | | 2 | | 4 | | 6 | | 8 | 9 | 10 | | | | | | | | | 19 | |
| 3 | 1 | 2 | 3 | 4 | 5 | 6 | 7 | 8 | 9 | 10 | 11 | 12 | | 14 | 15 | 16 | 17 | | 19 | 20 |
| 4 | 1 | | 3 | | 5 | | 7 | | 9 | | | | | | | | | | | |
| 5 | | 2 | | 4 | | 6 | 7 | 8 | | 10 | | | | | | | 17 | | | |
| 6 | 1 | 2 | 3 | 4 | | 6 | | 8 | | 10 | | 12 | | | | | | | | |
| 7 | 1 | 2 | 3 | 4 | 5 | 6 | 7 | 8 | 9 | 10 | | 12 | 13 | 14 | 15 | | 17 | 18 | 19 | 20 |
| 8 | 1 | | 3 | | 5 | | 7 | | 9 | | | | | | | | | | | |
| 9 | 1 | 2 | | 4 | | 6 | | 8 | 9 | 10 | | | | | | | | | | 20 |
| 10 | | 2 | | 4 | 5 | 6 | | 8 | | 10 | | | | | 15 | | | | | |
| 11 | 1 | 2 | 3 | 4 | 5 | 6 | 7 | 8 | 9 | 10 | 11 | 12 | 13 | | 15 | 16 | 17 | 18 | | 20 |
| 12 | 1 | | 3 | | 5 | | 7 | | 9 | | | | | | | | | | | |
| 13 | | 2 | 3 | 4 | | 6 | | 8 | | 10 | | | 13 | | | | | | | |
| 14 | | 2 | | 4 | | 6 | 7 | 8 | 9 | 10 | | | | | | | | 18 | | |
| 15 | 1 | 2 | 3 | 4 | 5 | 6 | 7 | 8 | 9 | 10 | 11 | | 13 | 14 | 15 | 16 | | 18 | 19 | 20 |
| 16 | 1 | | 3 | | 5 | | 7 | | 9 | | | | | | | | | | | |
| 17 | | 2 | | 4 | 5 | 6 | 7 | 8 | | 10 | | | | | | 16 | | | | |
| 18 | 1 | 2 | | 4 | | 6 | | 8 | | 10 | 11 | | | | | | | | | |
| 19 | 1 | 2 | 3 | 4 | 5 | 6 | 7 | 8 | 9 | 10 | 11 | 12 | 13 | 14 | | 16 | 17 | 18 | 19 | |
| 20 | 1 | | 3 | | 5 | | 7 | | 9 | | | | | | | | | | | |
| 21 | | 2 | | 4 | | 6 | | 8 | 9 | 10 | | | | | | | | | 19 | |
| 22 | | 2 | 3 | 4 | 5 | 6 | | 8 | | 10 | | | | 14 | | | | | | |
| 23 | 1 | 2 | 3 | 4 | 5 | 6 | 7 | 8 | 9 | 10 | 11 | 12 | | 14 | 15 | 16 | 17 | | 19 | 20 |
| 24 | 1 | | 3 | | 5 | | 7 | | 9 | | | | | | | | | | | |
| 25 | 1 | 2 | 3 | 4 | | 6 | | 8 | | 10 | | 12 | | | | | | | | |
| 26 | | 2 | | 4 | | 6 | 7 | 8 | | 10 | | | | | | | 17 | | | |
| 27 | 1 | 2 | 3 | 4 | 5 | 6 | 7 | 8 | 9 | 10 | | 12 | 13 | 14 | 15 | | 17 | 18 | 19 | 20 |
| 28 | 1 | | 3 | | 5 | | 7 | | 9 | | | | | | | | | | | |
| 29 | | 2 | | 4 | 5 | 6 | | 8 | | 10 | | | | | 15 | | | | | |
| 30 | 1 | 2 | | 4 | | 6 | | 8 | 9 | 10 | | | | | | | | | | 20 |
| 31 | 1 | 2 | 3 | 4 | 5 | 6 | 7 | 8 | 9 | 10 | 11 | 12 | 13 | | 15 | 16 | 17 | 18 | | 20 |
| 32 | 1 | | 3 | | 5 | | 7 | | 9 | | | | | | | | | | | |
| 33 | | 2 | | 4 | | 6 | 7 | 8 | 9 | 10 | | | | | | | | 18 | | |
| 34 | | 2 | 3 | 4 | | 6 | | 8 | | 10 | | | 13 | | | | | | | |
| 35 | 1 | 2 | 3 | 4 | 5 | 6 | 7 | 8 | 9 | 10 | 11 | | 13 | 14 | 15 | 16 | | 18 | 19 | 20 |
| 36 | 1 | | 3 | | 5 | | 7 | | 9 | | | | | | | | | | | |
| 37 | 1 | 2 | | 4 | | 6 | | 8 | | 10 | 11 | | | | | | | | | |
| 38 | | 2 | | 4 | 5 | 6 | 7 | 8 | | 10 | | | | | | 16 | | | | |
| 39 | 1 | 2 | 3 | 4 | 5 | 6 | 7 | 8 | 9 | 10 | 11 | 12 | 13 | 14 | | 16 | 17 | 18 | 19 | |
| 40 | 1 | | 3 | | 5 | | 7 | | 9 | | | | | | | | | | | |

FIG. 6

DOUBLE CROSS PARALLEL BINDER FABRIC

BACKGROUND OF THE INVENTION

1. Field of the Invention

The present invention relates to the papermaking arts. More specifically, the present invention relates to fabrics, such as forming fabrics, for use with a paper making machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam.

The present invention may relate specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics were developed. For example, in double and triple layer fabrics, the forming side is designed for sheet and fiber support while the wear side is designed for stability, void volume, and wear resistance.

Those skilled in the art will appreciate that fabrics are created by weaving, and having a weave pattern which repeats in both the warp or machine direction (MD) and the weft or cross-machine direction (CD).

Multi-layer fabrics, such as triple layer fabrics, may loosen during use and/or may have unacceptable resistance to abrasion. The present invention provides a fabric which overcomes such disadvantages.

SUMMARY OF THE INVENTION

Accordingly, the present invention is a multi-layer fabric which may be usable in the forming, pressing and/or drying sections of a paper making machine. The layers of such fabric may be held together by use of a plurality of pairs of binder yarns. A number of such pairs may be interwoven with the layers of the fabric such that the two yarns of each respective pair pass over at least one same MD or CD yarn on an outer surface of one of the layers.

According to an aspect of the present invention, a fabric is provided which comprises a first layer having machine direction (MD) yarns and cross-direction (CD) yarns interwoven therewith and a second layer having machine direction (MD) yarns and cross-direction (CD) yarns interwoven therewith. In such a fabric, a plurality of pairs of first type of binders each having a first binder and a second binder are interwoven with the first and second layers. The first and second binders of at least one pair are interwoven with the first and second layers so as to pass over at least one same yarn on an outer surface of the first layer.

In accordance with another aspect of the present invention, the fabric may further comprise a plurality of pairs of a second type of binders each being interwoven with the first and second layers wherein a weaving pattern of the second type of binders is different from that of the first type of binders. Neither binder of any pair of the second type of binders passes over one or more same yarns on the outer surface of the first layer. Further, the pairs of the first type of binders and the pairs of the second type of binders may be arranged in an alternating manner such that a respective pair of the first type of binders is located between two pairs of the second type of binders and a respective pair of the second type of binders is located between two pairs of the first type of binders.

The present invention will now be described in more complete detail with reference being made to the drawing figures, which are identified below in which corresponding components are identified by the same reference numerals.

BRIEF DESCRIPTION OF THE DRAWINGS

FIG. 6 is a view of a fabric pattern according to an embodiment of the present invention.

DETAILED DESCRIPTION OF THE PREFERRED EMBODIMENTS

The present invention pertains to a fabric such as a triple layer fabric which may be utilized in a papermaking process. Such triple layer fabric may include a first (upper) layer and a second (lower) layer in which each of the first and second layers has a system of machine-direction (MD) yarns and cross-machine direction (CD) yarns interwoven therewith. The first layer may be a paper side or faceside layer upon which the cellulosic paper/fiber slurry is deposited during the papermaking process and the second layer may be a machine side or backside layer. The first and second layers may be held together by use of a number of stitching or binding yarns. Such stitching yarns may be a number of CD and/or MD yarns. For example, a number of pairs of CD yarns may be used wherein the two yarns of each pair are located adjacent to each other and work in parallel. A pair of such CD yarns may be an integral or non-integral part of the weave pattern of either or both of the first and second layers and may also bind the two layers together. Hereinafter, a pair of yarns which is part of the weave pattern of either or both of the first and second layers and binds the two layers together will be referred to as a binding pair.

Figure 1A:
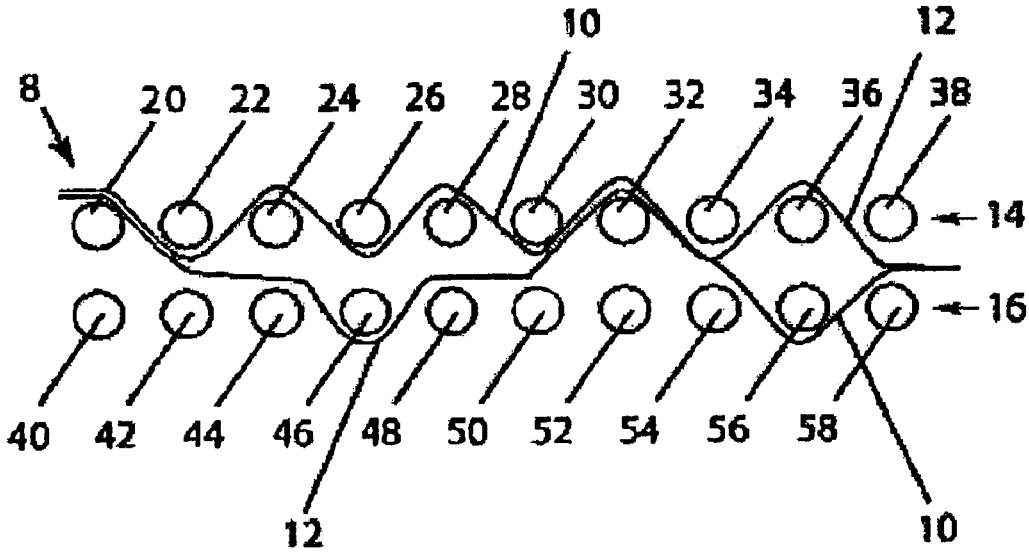
FIGS. 1A, 1B, and 1C are diagrams of cross-sectional views of a fabric according to an embodiment of the present invention.

FIG. 1A illustrates a portion or a repeating pattern of a binding pair 8. More specifically, FIG. 1A is a cross-sectional view of a part of a fabric 100 which includes a first (paper side) layer 14 and a second (machine side) layer 16 having a plurality of MID yarns 20–38 in the paper side layer 14, a plurality of MD yarns 40–58 in the machine side layer 16, and a number of binding pairs 8 each having CD yarns 10 and 12 interwoven with the MD yarns. As shown therein, CD yarn 10 passes over MD yarns 20, 24, 28, and 32 and passes under MD yarns 22, 26, 30, 34 and 38 of the paper side layer 14, and passes over MD yarns 54 and 58 and passes under MD yarn 56 of the machine side layer 16. CD yarn 12 passes over MD yarns 20, 32, and 36 and passes under MD yarns 22, 24, 28, 30, 34, and 38 of the paper side layer 14, and passes over MD yarns 42, 44, 48, and 50 and passes under MD am 46 of the machine layer 16.

Figure 1B:
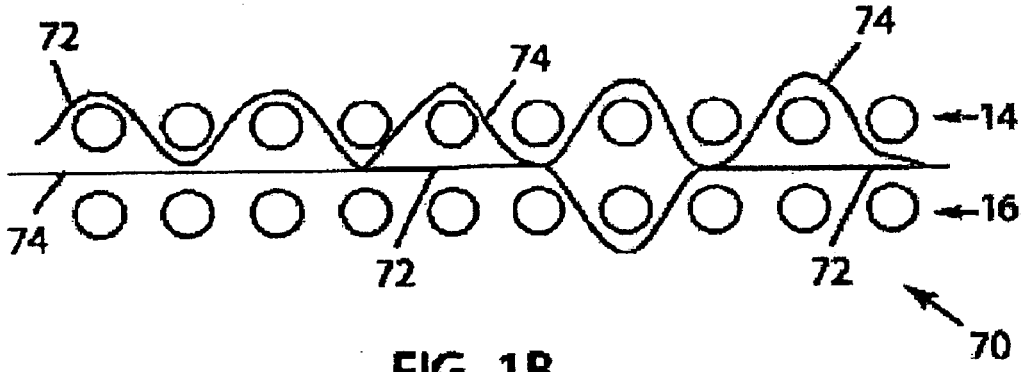
Figure 1C:
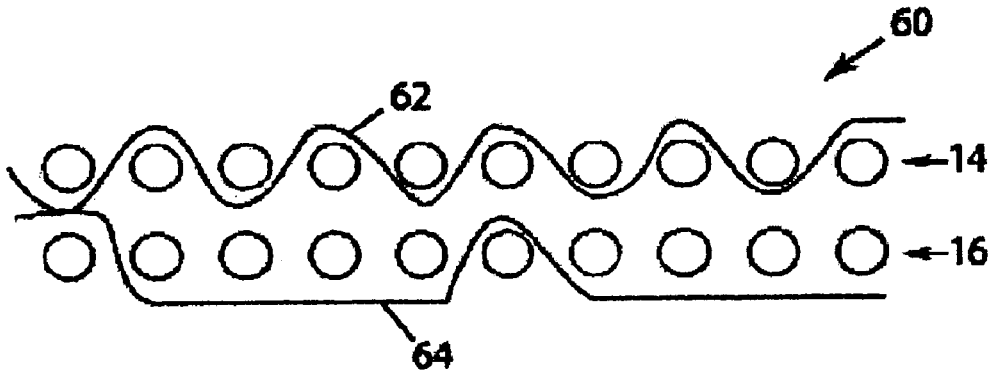
Figure 1D:
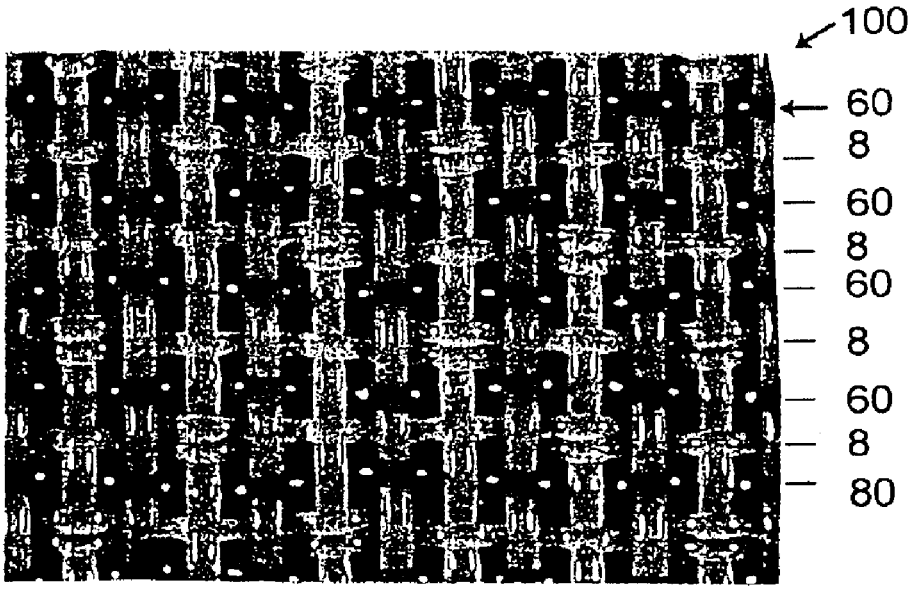
FIGS. 1D and 1E are paper side and machine side views of a fabric woven in accordance with the present invention.
Figure 1E:
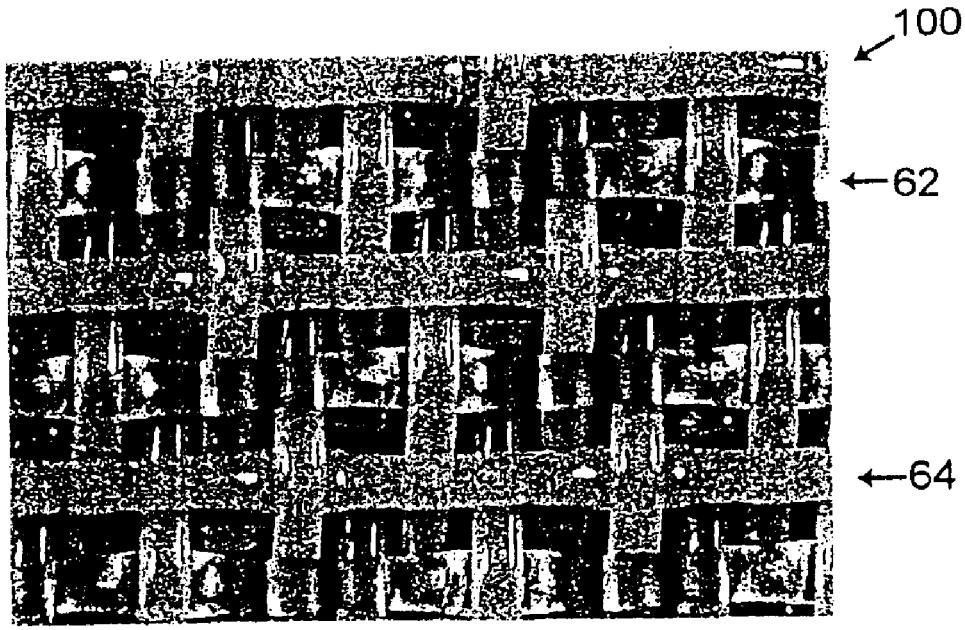

A plurality of binding pairs 8 may be interwoven into fabric 100 as shown in FIG. 1D (which is a paper side view of the fabric) and FIG. 1E (which is a machine side view of the fabric). Additionally, a number of CD pairs 60 may also be interwoven into the fabric 100 and arranged therein between adjacent ones of the binding pairs 8. Each of the CD pairs may have CD yarns 62 and 64 which may be interwoven with the MD yarns of the paper side layer 14 and the machine side layer 16 as shown in FIG. 1C. Further, a number of pairs 70 each including CD yarns 72 and 74 may also be interwoven with the MD yarns of the paper side layer 14 and machine side layer 16 of the fabric 100 as, for example, shown in FIG. 1B.

Therefore, in the fabric 100, each of the yarns 10 and 12 of the binding pair 8 passes over MD yarns 20 and 32 on an outer surface of the paper side layer 14. Such type of binding pair is hereinafter referred to as a double cross parallel (DCP) type binder pair. Accordingly, the fabric 100 has two interwoven layers of CD and MD yarns which are held together by a plurality of DCP type binder pairs wherein the two yarns of each such binder pair pass over two MD yarns on an outer surface of the paper side 14 within a repeat pattern.

Another fabric will now be described with reference to FIGS. 2A–D.

Figure 2A:
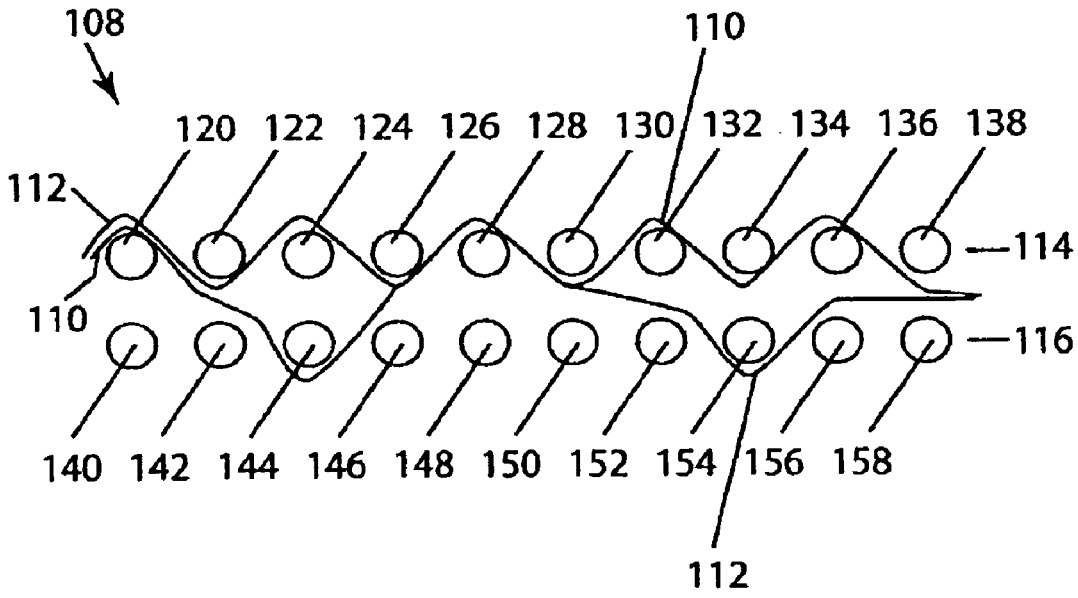
FIGS. 2A and 2B are diagrams of cross-sectional views of a fabric according to another embodiment of the present invention.
Figure 2B:
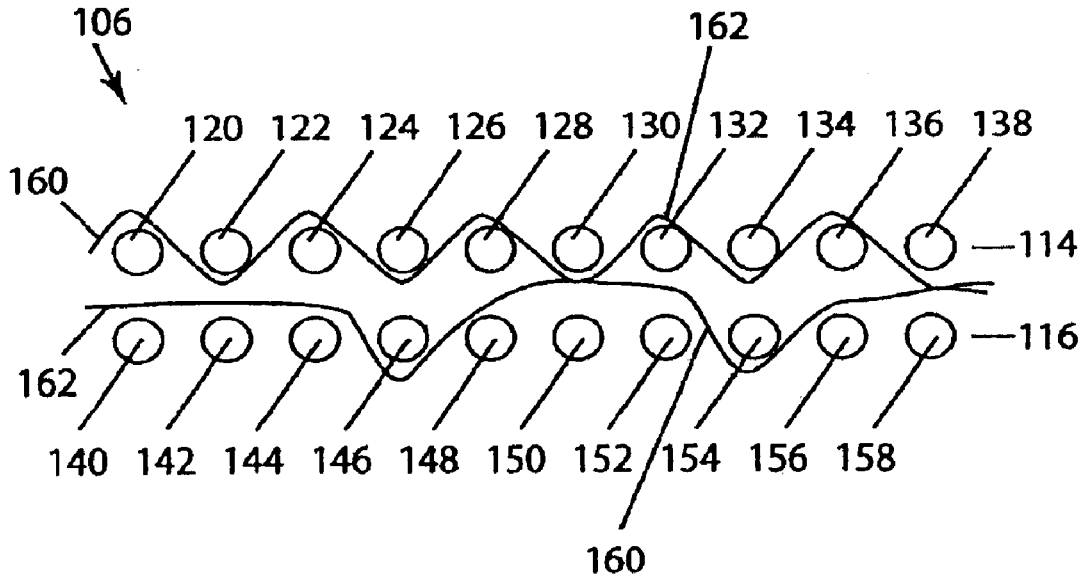
Figure 2C:
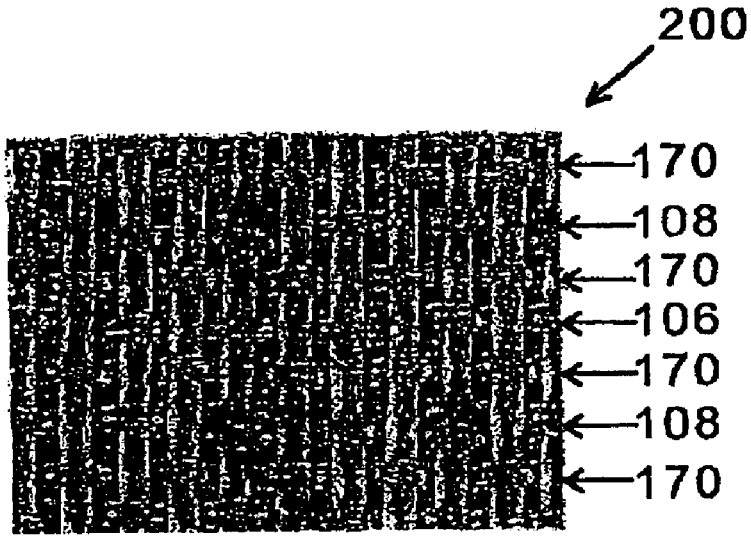
FIGS. 2C and 2D are paper side and machine side views of a fabric woven in accordance with the present invention.
Figure 2D:
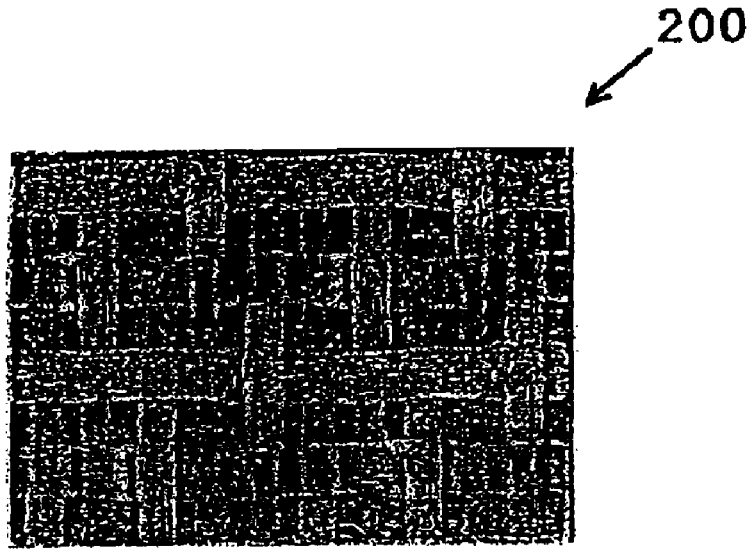

FIG. 2A illustrates a portion or a repeating pattern of a binding pair 108 of a fabric 200 having a first (paper side) layer 114 and a second (machine side) layer 116. More specifically, FIG. 2A is a cross-sectional view illustrating a plurality of MD yarns 120–138 in the paper side layer 114, a plurality of MD yarns 140–158 in the machine side layer 116, and binding pair 108 having CD yarns 110 and 112 interwoven with the MD yarns. As shown in FIG. 2A, in binder pair 108, CD yarn 110 passes over MD yarns 120, 128, 132, and 136 and passes under MD yarns 122, 126, 130, 134 and 138 of the paper side layer 114, and passes over MD yarns 142 and 146 and passes under MD yarn 144 of the machine side layer 116. CD yarn 112 passes over MD yarns 120, 124, and 128 and passes under MD yarns 122, 126, 130, 132, 136 and 138 of the paper side layer 114, and passes over MD yarns 150, 152, 156, and 158 and passes under MD yarn 154 of the machine layer 116. A number of binding pairs 108 may be interwoven into fabric 200 as shown in FIG. 2C (which is a paper side view of the fabric) and FIG. 2D (which is a machine side view of the fabric).

Additionally, a number of binder pairs 106 each having CD yarns 160 and 162 may also be interwoven with the MD yarns of the fabric 200 and arranged therein in an alternating manner with the binding pairs 108. Each of the binder pairs 106 (which may be referred to as a support shute binder (SSB) type) may have CD yarns 160 and 162 which may be interwoven with the MD yarns of the paper side layer 114 and the machine side layer 116 as shown in FIG. 2B. As illustrated in FIG. 2B, CD yarns 160 and 162 do not pass over one or more same MD yarns on an outer surface of the paper side layer 114. Further, a number of CD yarns 170 may also be interwoven into the fabric 200 and arranged such that respective ones of CD yarns 170 are located on either side of binding pairs 106 and 108 as, for example, shown in FIG. 2C. CD yarns 170 may be similar to CD yarns 62 and 64 shown in FIG. 1C.

Therefore, in the fabric 200, each of the yarns 110 and 112 of the binding pair 108 passes over MD yarns 120 and 128 on an outer surface of the paper side layer 114. Thus, binding pair 108 is a DCP type binder pair. Accordingly, the fabric 200 has two interwoven layers of CD and MD yarns which are held together by a plurality of DCP type binder pairs wherein the two yarns of each such binder pair pass over two MD yarns on an outer surface of the paper side 114 within a repeat pattern. Further, the arrangement of binders in the fabric 200 enables relatively high permeability.

Another fabric will now be described with reference to FIGS. 3A–D.

Figure 3A:
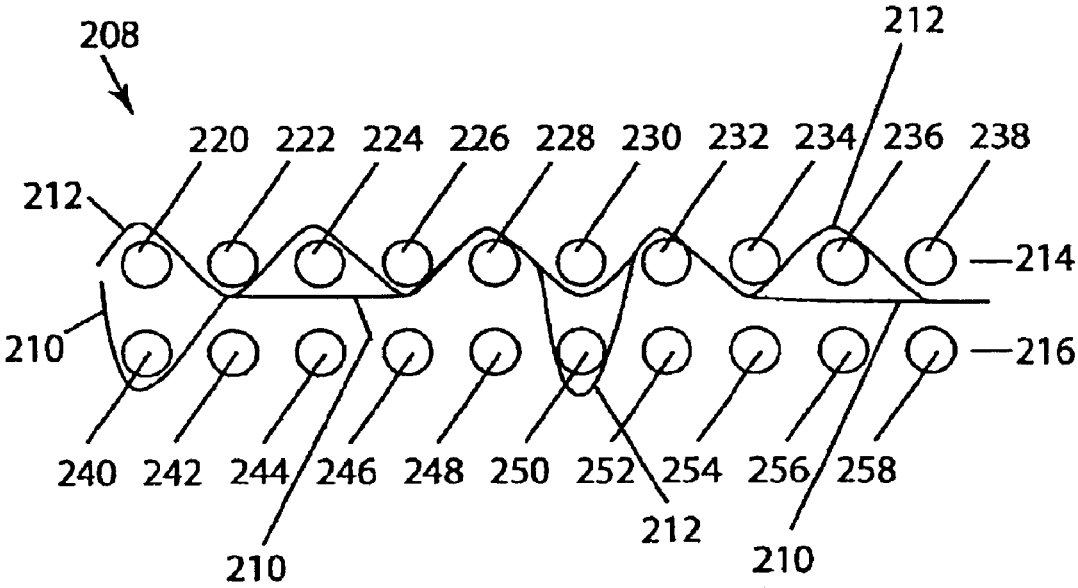
FIGS. 3A and 3B are diagrams of cross-sectional views of a fabric according to another embodiment of the present invention.

FIG. 3A illustrates a portion or a repeating pattern of a binding pair 208 having a first (paper side) layer 214 and a second (machine side) layer 216. More specifically, FIG. 3A is a cross-sectional view of a part of a fabric 300 illustrating a plurality of MD yarns 220–238 in the paper side layer 214, a plurality of MD yarns 240–258 in the machine side layer 216, and binding pair 208 having CD yarns 210 and 212 interwoven with the MD yarns. As shown therein, CD yarn 212 passes over MD yarns 220, 224, 228, 232, and 236 and passes under MD yarns 222, 226, 234 and 238 of the paper side layer 214, and passes under MD yarn 250 of the machine side layer 116. CD yarn 210 passes over MD yarns 228 and 232 and passes under MD yarns 222, 224, 226, 230, 234, 236 and 238 of the paper side layer 214, and passes over MD yarns 242, 244, 246, 254, 256, and 258 and passes under MD yarn 240 of the machine layer 216. A number of binding pairs 208 may be interwoven into fabric 300 as shown in FIG. 3C (which is a paper side view of the fabric) and FIG. 3D (which is a machine side view of the fabric).

Figure 3B:
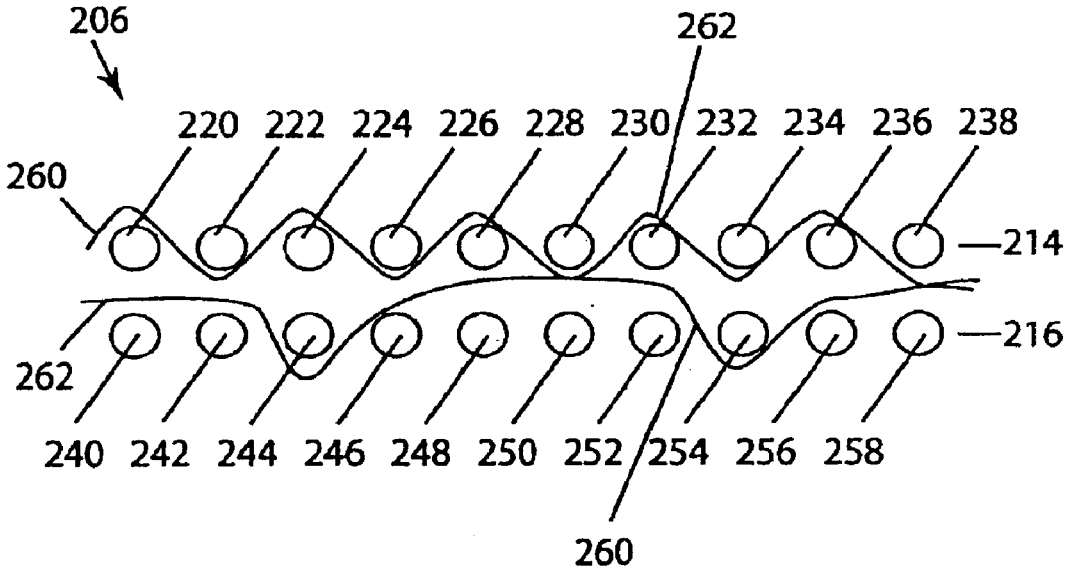

Additionally, a number of binding pairs 206 may be interwoven in the fabric 300 and arranged therein in an alternating manner with the binding pairs 208. Each of the pairs 206 (which may be SSB type binders) may have CD yarns 260 and 262 which may be interwoven with the MD yarns of the paper side layer 214 and the machine side layer 216 as shown in FIG. 3B. As illustrated in FIG. 3B, CD yarns 260 and 262 do not pass over one or more same MD yarns on an outer surface of the paper side layer 214.

Figure 3C:
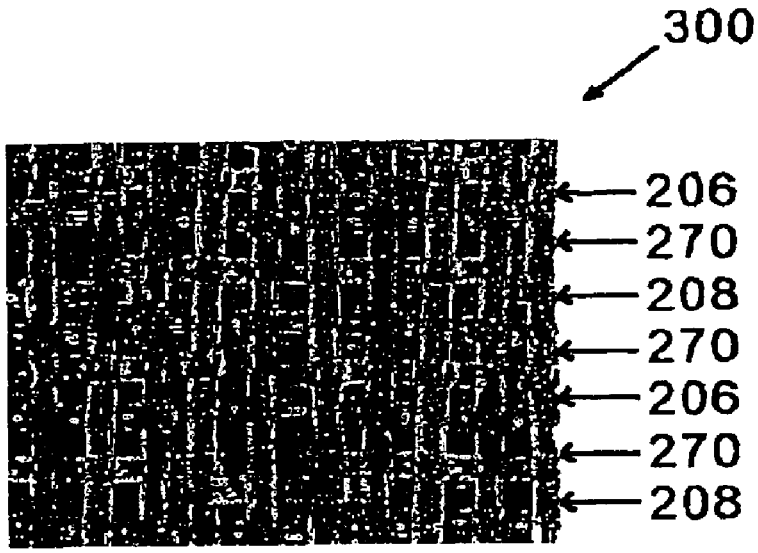
FIGS. 3C and 3D are paper side and machine side views of a fabric woven in accordance with the present invention.
Figure 3D:
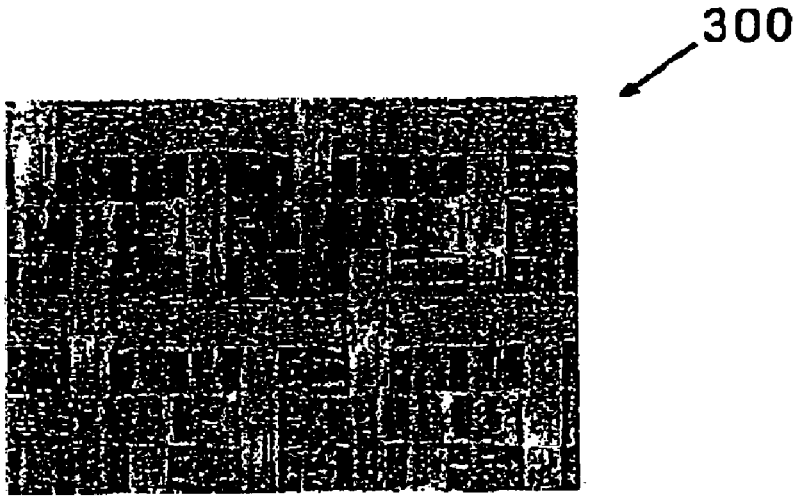

Further, a number of CD yarns 270 may also be interwoven into the fabric 300 and arranged such that respective ones of CD yarns 270 are located on either side of binding pairs 208 and CD pairs 206 as, for example, shown in FIG. 3C. CD yarns 270 may be similar to CD yarns 62 and 64 shown in FIG. 1C.

Therefore, in the fabric 300, each of the yarns 210 and 212 of the binding pair 208 passes over MD yarns 228 and 232 on an outer surface of the paper side layer 214. Thus, binding pair 208 is a DCP type binder pair. Accordingly, the fabric 300 has two interwoven layers of CD and MD yarns which are held together by a plurality of DCP type binder pairs and SSB type binder pairs wherein the two yarns of each DCP binder pair pass over two MD yarns on an outer surface of the paper side 14 within a repeat pattern. Further, the arrangement of binders in the fabric 300 may provide a direct pass from the top to the bottom and, as such, may improve the internal wear resistance of the fabric as compared to fabrics having other arrangements.

Another fabric will now be described with reference to FIGS. 4A–D.

Figure 4A:
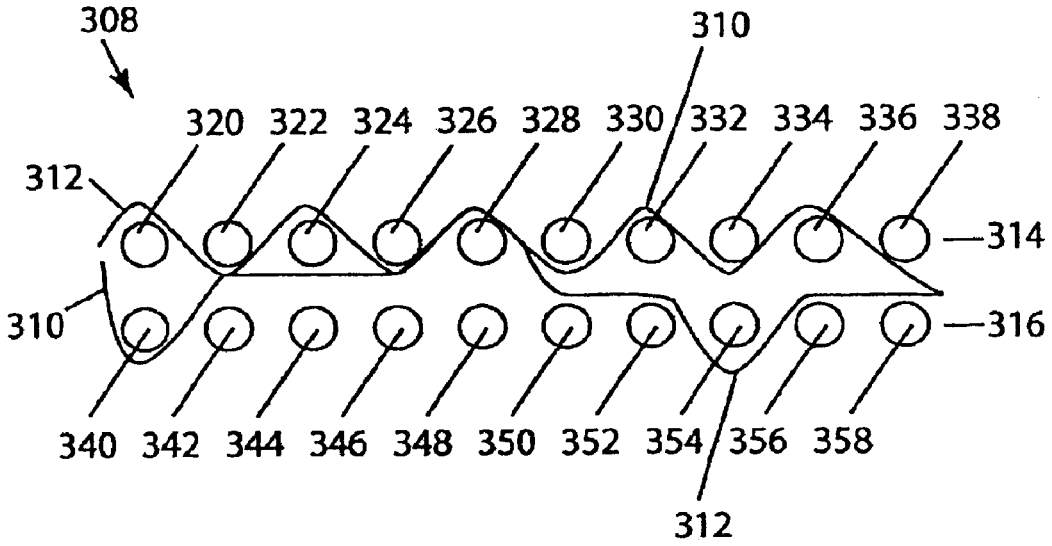
FIGS. 4A and 4B are diagrams of cross-sectional views of a fabric according to another embodiment of the present invention.

FIG. 4A illustrates a portion or a repeating pattern of a binding pair 308 of a fabric 400 having a first (paper side) layer 314 and a second (machine side) layer 316. More specifically, FIG. 4A is a cross-sectional view illustrating a plurality of MD yarns 320–338 in the paper side layer 314, a plurality of MD yarns 340–358 in the machine side layer 316, and binding pair 308 having CD yarns 310 and 312 interwoven with the MD yarns. As shown in FIG. 4A, CD yarn 312 passes over MD yarns 320, 324, and 328 and passes under MD yarns 322, 326, 330, 332, 336, and 338 of the paper side layer 314, and passes over MD yarns 350, 352, 356, 358 and passes under MD yarn 354 of the machine side layer 316. CD yarn 310 passes over MD yarns 328, 332, and 336 and passes under MD yarns 322, 324, 326, 330, 334 and 338 of the paper side layer 314, and passes over MD yarns 342, 344, 346, 350, 354 and 358 and passes under MD yarn 340 of the machine layer 316. A number of binding pairs 308 may be interwoven into fabric 400 as shown in FIG. 4C (which is a paper side view of the fabric) and FIG. 4D (which is a machine side view of the fabric).

Figure 4B:
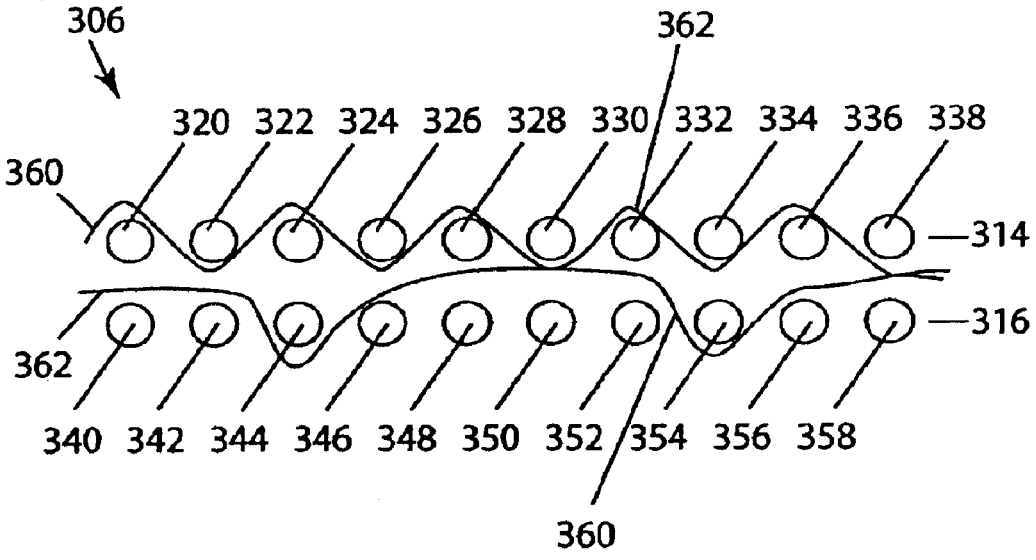

Additionally, a number of binder pairs 306 may also be interwoven into the fabric 400 and arranged therein in an alternating manner with the binding pairs 308. Each of the binder pairs 306 (which may be SSB type binders) may have CD yarns 360 and 362 which may be interwoven with the MD yarns of the paper side layer 314 and the machine side layer 316 as shown in FIG. 4B. As illustrated in FIG. 4B, CD yarns 260 and 262 do not pass over one or more same MD yarns on an outer surface of the paper side layer 314.

Figure 4C:
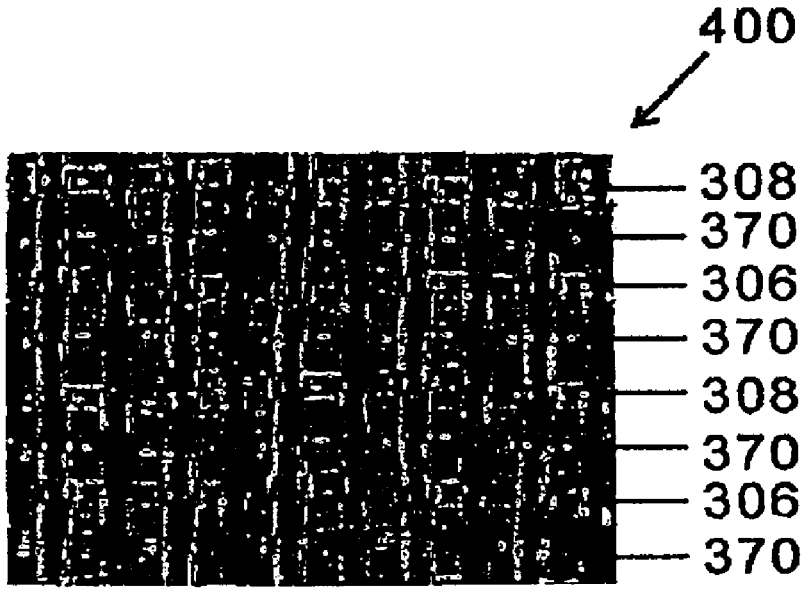
FIGS. 4C and 4D are paper side and machine side views of a fabric woven in accordance with the present invention.
Figure 4D:
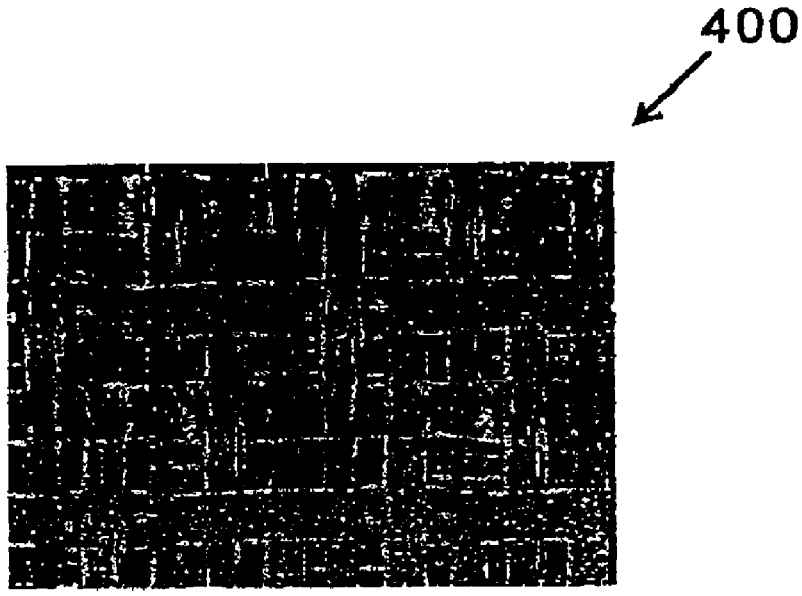

Further, a number of CD yarns 370 may also be interwoven into the fabric 400 and arranged such that respective ones of CD yarns 370 are located on either side of binding pairs 306 and 308 as, for example, shown in FIG. 4C. CD yarns 370 may be similar to CD yarns 62 and 64 shown in FIG. 1C.

Therefore, each of the yarns 310 and 312 of the binding pair 308 passes over MD yarn 328 on an outer surface of the paper side layer 314. Thus, binding pair 308 is a DCP type binder pair.

Accordingly, the fabric 400 has two interwoven layers of CD and MD yarns which are held together by a plurality of DCP type binder pairs and SSB type binder pairs wherein the two yarns of each DCP binder pair pass over only one MD yarn on an outer surface of the paper side 314 within a repeat pattern. As a result, the MD or warps yarns may be offstacked and a symmetric binder contour may be obtained. Further, such arrangement may minimize the number of crossings, decrease the level of marking, decrease the caliper, and improve the seamability as compared to fabrics having other arrangements.

In the above-described fabrics, the CD yarns of the DCP type binder pairs do not cross each other as they pass below a transitional top MD yarn. Instead, such yarns are adjacent to each other as they pass over one or more same MD yarns.

Figure 5:
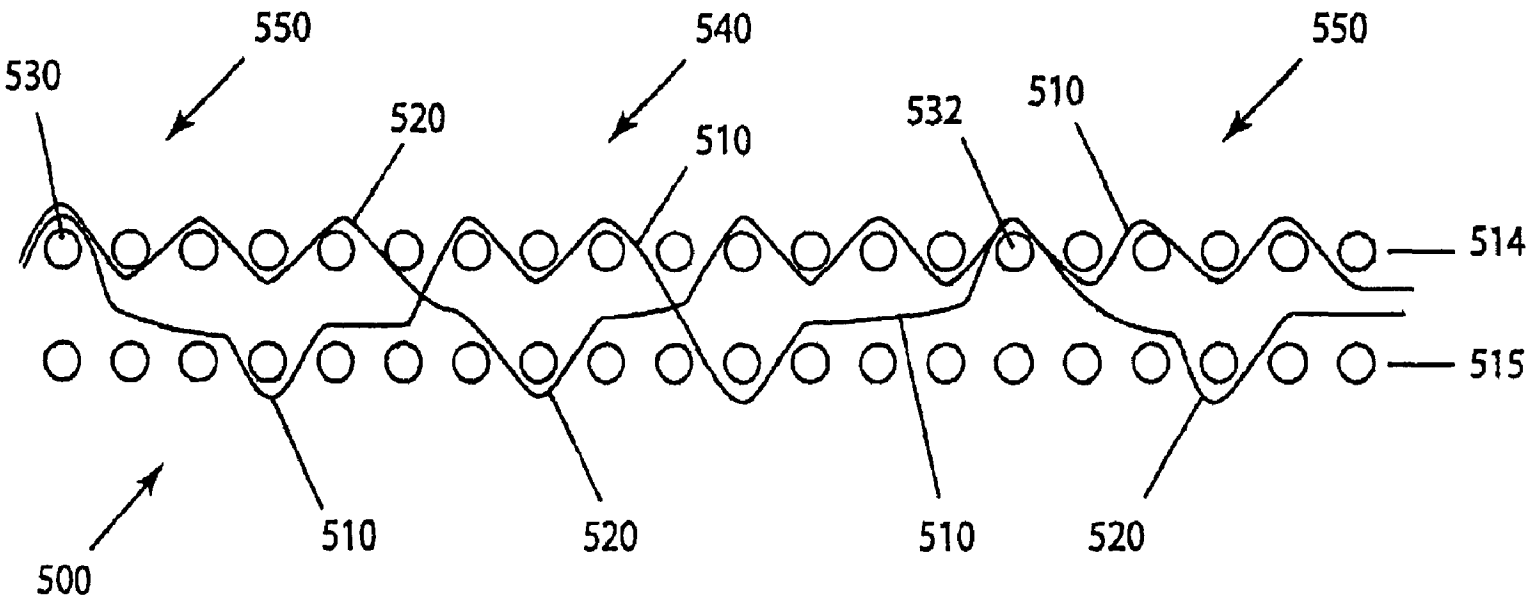
FIG. 5 is a diagram of cross-sectional view of a fabric according to another embodiment of the present invention.

Although specific patterns have been described above, the present invention is not so limited. For example, other patterns for the binder pairs such as that shown in FIG. 5 which includes a combination of DCP type binder pair and SSB binder pair within a repeat pattern. More specifically, FIG. 5 is a cross-sectional view of a part of a fabric 500 which includes a first (paper side) layer 514 and a second (machine side) layer 516 having a plurality of MD yarns therein and a number of binder pairs each having CD yarns 510 and 520. As shown in FIG. 5, CD yarns 510 and 520 each pass over MD yarns 530 and 532. The binder pair of FIG. 5 includes a number of DCP portions 550 and SSB portions 540. FIG. 6 illustrates a weaving pattern for a fabric which may use binder pairs. Additionally, the weave patterns for the upper (paper side) layer may be plain weave pattern or other patterns. Similarly, the lower (machine side) may be woven on 4, 5, or 6 sheds, or other arrangements may be used.

Further, a number of the binder pairs within a fabric may be woven such that the two yarns within such pairs are arranged in the same side by side (or straight) manner for all such binder pairs. Additionally, a number of the binder pairs within the fabric may be woven such that the two yarns within such pairs are arranged in alternating or reverse side by side manner. As an example, in the above-described fabrics having SSB binder pairs, the SSB binder pairs may be arranged so as to be straight or reversed.

Furthermore, although the present invention has been described as having a binding pair consists of CD yarns which pass over one or two MD yarns on an outer surface of the paper side layer, the present invention is not so limited. That is, other arrangements may also be utilized. For example, there may be CD yarns which pass over more than two MD yarns on an outer surface of the paper side layer within a repeat pattern. As another example, the binder pair may include two MD yarns which pass over one or more same CD yarns within a repeat pattern. As still another example, the binder yarns may pass over one or more same CD (or MD) yarns on an outer surface of the machine side layer within a repeat pattern.

Additionally, although the present invention has been described as usable for the papermaking process, the present invention is not so limited. That is, the present fabric may be utilized for other uses.

The fabric according to the present invention may comprise monofilament yarns. The CD yarns may be polyester monofilament and/or some may be polyester or polyamide. The CD and MD yarns may have a circular cross-sectional shape with one or more different diameters. Further, in addition to a circular cross-sectional shape, one or more of the yarns may have other cross-sectional shapes such as a rectangular cross-sectional shape or another non-round cross-sectional shape.

Modifications to the above would be obvious to those of ordinary skill in the art, but would not bring the invention so modified beyond the scope of the present invention. The claims to follow should be construed to cover such situations.

What is claimed is:

1. A fabric for use in making paper, said fabric comprising:

a first layer of machine direction (MD) yarns;

a second layer of machine direction (MD) yarns;

a first layer of cross-machine direction (CD) yarns;

a second layer of cross-machine direction (CD) yarns; and a plurality of a first type of groups of additional cross-machine direction (CD) binder yarns each having a first CD yarn and a second CD yarn;

wherein said first and second CD yarns in at least one of the first type of groups are interwoven with said MD yarns of said first and second layers and pass over at least one same MD yarn on an outer surface of one of said first and second layers within a repeat pattern.

2. The fabric according to claim 1, wherein the first layer is a paper side upon which the cellulosic fiber slurry is deposited during a papermaking process and wherein said first CD yarn and said second CD yarn of said at least one of the first type of groups pass over said at least one same MD yarn on the outer surface of said first or paper side layer within the repeat pattern.

3. The fabric according to claim 1, wherein said first CD yarn and said second CD yarn of said at least one of the first type of groups pass over two same MD yarns on the outer surface of one of said first and second layers within the repeat pattern.

4. The fabric according to claim 1, further comprising a plurality of second type of groups of cross-machine direction (CD) binder yarns each group having two CD yarns and a weaving pattern different from that of the first type of groups of the CD yarns.

5. The fabric according to claim 4, wherein neither CD yarn of any of the second type of groups pass over a same yarn on the outer surface of said first layer within the repeat pattern.

6. The fabric according to claim 4, wherein the groups of the first type of CD binder yarns and the groups of the second type of CD binder yarns are arranged in an alternate manner such that the CD yarns of a respective one of the first type groups are located between two second type groups and the CD yarns of a respective one of the second type groups are located between two first type groups.

7. The fabric according to claim 6, wherein each of a number of the first and second type groups are respectively located between two CD yarns such that a pair of the first type of binders is located between two respective CD yarns one of which is located adjacent to a pair of the second type of binders, which is located adjacent to another CD yarn, which is located adjacent to another pair of the first type of binders, and so forth.

8. The fabric according to claim 2, wherein the first or paper side layer has a plain weave pattern.

9. The fabric according to claim 8, wherein the second or machine layer is woven in one of a four, five, and six-shed weave pattern.

10. The fabric according to claim 2, wherein the MD and CD yarns are monofilament yarns.

11. The fabric according to claim 1, wherein the fabric is usable in at least one of a forming, pressing, and drying operation of a papermaking process.

12. The fabric according to claim 1, wherein at least some of the MD yarns are one of polyamide yarns or polyester yarns.

13. The fabric according to claim 1, wherein at least some of the CD yarns are one of polyamide yarns or polyester yarns.

14. The fabric according to claim 1, wherein at least some of the MD yarns and CD yarns have one of a circular cross-sectional shape, a rectangular cross-sectional shape and a non-round cross-sectional shape.

15. A fabric comprising:

a first layer having machine direction (MD) yarns and cross-direction (CD) yarns interwoven therewith; and a second layer having machine direction (MD) yarns and cross-direction (CD) yarns interwoven therewith;

wherein a plurality of pairs of first type of binders each having a first binder and a second binder are interwoven with said first and second layers, and wherein said first and second binders of at least one pair are interwoven with said first and second layers so as to pass over at least one same yarn on an outer surface of said first layer.

16. The fabric according to claim 15, wherein the fabric is usable in a papermaking process and wherein the first layer is a paper side upon which cellulosic fiber is deposited during the papermaking process.

17. The fabric according to claim 16, wherein said first binder and said second binder of said at least one pair pass over two same yarns on the outer surface of said first or paper side layer within a repeat pattern.

18. The fabric according to claim 15, further comprising a plurality of pairs of second type of binders each being interwoven with said first and second layers wherein a weaving pattern of the second type of binders is different from that of the first type of binders.

19. The fabric according to claim 18, wherein neither binder of any pair of the second type of binders pass over at least one same yarn on the outer surface of said first layer.

20. The fabric according to claim 18, wherein the pairs of the first type of binders and the pairs of the second type of binders are arranged in an alternate manner such that a pair of a respective one of the first type of binders is located between two pairs of the second type of binders and a pair of a respective one of the second type of binders is located between two pairs of the first type of binders.

21. The fabric according to claim 20, wherein each of a number of the pairs of the first and second type of binders are respectively located between two CD yarns such that a pair of the first type of binders is located between two respective CD yarns one of which is located adjacent to a pair of the second type of binders, which is located adjacent to another CD yarn, which is located adjacent to another pair of the first type of binders, and so forth.

22. The fabric according to claim 16, wherein the first or paper side layer has a plain weave pattern.

23. The fabric according to claim 22, wherein the second layer is woven in one of a four, five, and six-shed weave pattern.

24. The fabric according to claim 16, wherein the fabric is usable in at least one of a forming, pressing, and drying operation of the papermaking process.

25. The fabric according to claim 15, wherein the MD and CD yarns are monofilament yarns.

26. The fabric according to claim 15, wherein at least some of the MD yarns are one of polyamide yarns or polyester yarns.

27. The fabric according to claim 15, wherein at least some of the CD yarns are one of polyamide yarns or polyester yarns.

28. The fabric according to claim 15, wherein at least some of the MD yarns and CD yarns have one of a circular cross-sectional shape, a rectangular cross-sectional shape and a non-round cross-sectional shape.

29. The fabric according to claim 15, wherein first type of binders are CD type yarns.

30. The fabric according to claim 29, wherein said first and second binders of the at least one pair are interwoven with said first and second layers so as to pass over at least one same MD yarn on an outer surface of said first layer.

31. The fabric according to claim 15, wherein first type of binders are MD type yarns.

32. The fabric according to claim 31, wherein said first and second binders of the at least one pair are interwoven with said first and second layers so as to pass over at least one same CD yarn on an outer surface of said first layer.

* * * * *